US006229119B1

(12) United States Patent
Petri et al.

(10) Patent No.: US 6,229,119 B1
(45) Date of Patent: May 8, 2001

(54) FITTING A CASING OF A SWITCHING DEVICE

(75) Inventors: Heinz Petri, Bretten; Siegfried Mannuss, Sternenfels; Eugen Wilde, Knittlingen, all of (DE)

(73) Assignee: E.G.O. Elektro-Geratebau GmbH (DE)

( * ) Notice: Subject to any disclaimer, the term of this patent is extended or adjusted under 35 U.S.C. 154(b) by 0 days.

(21) Appl. No.: 09/416,569

(22) Filed: Oct. 12, 1999

(30) Foreign Application Priority Data

Oct. 9, 1998 (DE) ..... 198 46 512

(51) Int. Cl.[7] ..... H05B 3/68
(52) U.S. Cl. ..... 219/448.11; 219/448.19
(58) Field of Search ..... 219/448.11, 448.17, 219/448.18, 448.19, 460.1, 461.1, 451.1, 452.11

(56) References Cited

U.S. PATENT DOCUMENTS 4,350,875 * 9/1982 McWilliams ..... 219/448.19
4,845,340 * 7/1989 Goessler et al. ..... 219/448.19
5,420,398 * 5/1995 Petri et al. ..... 219/448.19
5,489,764 * 2/1996 Mannuss et al. ..... 219/448.19

* cited by examiner

*Primary Examiner*—Sang Paik
(74) *Attorney, Agent, or Firm*—Akerman Senterfitt

(57) ABSTRACT

A casing (11) of a thermostat (12), which is to be fixed to the rim (17) of a reception container (16) for a heating device, is substantially inserted in a recess (23) of the rim (17). The recess (23) is open to the outer edge of the rim (17) and has two lateral boundaries (24). In the fitted state the casing (11) forms a mechanical connection between the lateral boundaries (24) and closes the transmission of forces in the course of the rim (17) and in particular clamps together the rim in the circumferential direction. The fastening of the casing (11) and the bracing takes place by means of at least partly bent round and/or bend roundable fastening tongues (25) and/or clamping tongues (27), preferably emanating from the lateral boundaries (24). The invention inter alia leads to a positionally reliable positioning of the thermostat (12) on the reception container (16).

12 Claims, 2 Drawing Sheets

FITTING A CASING OF A SWITCHING DEVICE

FIELD OF APPLICATION AND PRIOR ART

The invention relates to the installation or fitting of a casing of a switching device, particularly a thermostat, on the rim or border of a receiving container for a heating device, the rim having a recess in which the casing at least partly engages, the recess being provided with two lateral boundaries and being open towards the outer edge.

DE 41 38 817 describes how a casing of a thermostat is fixed by means of a two-legged, angular holder to a tray jacket of a support tray for a ring-type heater. In addition, constructions are described according to which the casing engages by means of fastening members projecting from the tray jacket and which are introduced into through openings in the casing and whose end is subsequently twisted for fixing purposes. An upper web can be left as a frame for stabilization purposes in the recess in the tray jacket, into which the casing partly projects.

PROBLEM AND SOLUTION

The problem of the invention is to obviate the disadvantages of the prior art with respect to fitting or assembly possibilities, whilst improving the stability of the rim of the reception container for a heating device.

This problem is solved by the features of claim 1. Advantageous developments of the invention form the subject matter of the subclaims.

According to the invention, the fastening of the casing to the reception container can extend beyond a mere fastening and additionally fulfil a second function, namely using the casing in the fitted state as a reinforcement of the rim weakened by the recess. In particular tensile loads, which could lead to a widening of the recess by pressing up the rim, can be absorbed in this way.

It is possible to insert the casing in the recess from the outer edge towards the rim, i.e. preferably parallel to the surface of the recess. During insertion at least one portion of the rim can engage in a corresponding recess in the casing. At least one further portion can, following the insertion of the casing, engage in a corresponding recess or opening in the casing by bending over. There is no need to bend over all the portions after insertion, which facilitates installation. The portions can advantageously be connected to the casing in different rim-parallel surfaces in order to adequately fix the casing and stabilize the rim.

Preferably the portions are at least partly constructed as bending tongues, so that complicated connecting methods such as screwing riveting or welding can be avoided. The bending tongues are connected in one piece to or rough-worked from the border, preferably from the area removed by the formation of the recess. This avoids unnecessary weakening of the border. Advantageously at least one bending tongue is bent down prior to the insertion of the casing, particularly along one of the lateral boundaries. This is particularly advantageous for bending tongues which are used for the transmission of forces between rim-casing-rim. Further bending tongues can be further or for the first time bent over during or preferably after insertion.

At least one portion can have in its course a material weakening, e.g. in the form of a unilateral or bilateral slot, the resulting end portion being an additional twisting tongue for fixing the casing to the rim.

At least one connection between a portion and the casing can be displaced with respect to the surface in which the recess is located. In the case of a cylinder envelope or the like as the rim, it is appropriate to radially outwardly displace the connection. This makes it possible to adequately absorb tilting moments of the casing with respect to a tilt line running roughly along the surface of the recess.

Preferably in each case at least one portion leads off from the rim in the vicinity of both lateral boundaries and preferably directly from the latter, said portions extending through at least part of the casing and having twistable end portions for fixing the casing to the rim. At least one and preferably two portions bent over following the insertion of the casing and which can emanate from the lateral boundaries, preferably brace the rim with the casing in the rim running direction. According to a preferred variant the tensional force can rise with increasing bending over. As a result of this bracing in the manner of a radial constriction the rim is stabilized and in particular secured against widening. It is possible to form stops by projections or the like of the casing engaging on the lateral boundaries and against which the rim and consequently the lateral boundaries can be braced by bending over. In this way it is possible to produce a precisely definable size of the recess or an exact final shape of the rim.

By bending over at least one portion, the casing can be pressed, particularly in the insertion direction, following insertion in the recess. The compressive force preferably rises with increasing bending over. This not only secures the casing in the recess, but also ensures a firm connection of the casing with the rim. Advantageously the casing is secured along all the boundaries of the recess at least in one and preferably in two movement directions.

Preferably the recess is substantially rectangular with two lateral boundaries and one longitudinal boundary connecting them, the longitudinal boundary preferably being longer than the lateral boundaries and in particular at least twice as long.

The casing can engage over the recess on at least one lateral boundary in the direction of the rim. It advantageously bears with a bearing surface on the outside of the rim outside and in particular laterally alongside the recess. Thus, the casing can cover and/or frame the recess.

With at least one bearing nose the casing can extend into the recess or engage thereon in the vicinity of the lateral boundaries. If the bearing nose engages over a portion of the lateral boundary, the casing is fixed both in the rim running direction and also transversely thereto.

The rim is preferably a cylinder envelope, particularly rounded or circular cylindrical. Preferably the rim forms the jacket of a shallow, cup-shaped tray, such as is e.g. used for receiving radiant heaters.

The casing can have a projection extending into the recess and provided with a reception slot, which runs preferably approximately in the direction of the rim and/or roughly parallel to the surface of the recess. On inserting the casing, a marginal area located between the lateral boundaries can be introduced into this reception slot and said marginal area is preferably a projecting portion. This projecting portion can be subsequently bent round, optionally with the aid of the casing, in order to modify the casing position and fix it after bending round. Alternatively or additionally the reception slot can also engage over the rim over the marginal area of the recess.

The rim is advantageously in one piece and the portions can be rough-worked by punching. The reception container is preferably of sheet metal and can be easily manufactured by punching.

The casing is preferably made from an electrically insulating, stable material, e.g. plastic or ceramic and it is preferably in one piece.

These and further features can be gathered from the claims, description and drawings and the individual features, either singly or in the form of subcombinations, can be implemented in an embodiment of the invention and in other fields and can represent advantageous, independently protectable constructions for which protection is claimed here. The subdivision of the application into individual sections and the subtitles in no way restricts the general validity of the statements made thereunder.

BRIEF DESCRIPTION OF THE DRAWINGS

Preferred embodiments of the invention are described hereinafter relative to the attached drawings, wherein show.

DETAILED DESCRIPTION OF THE EMBODIMENTS

Figure 1:
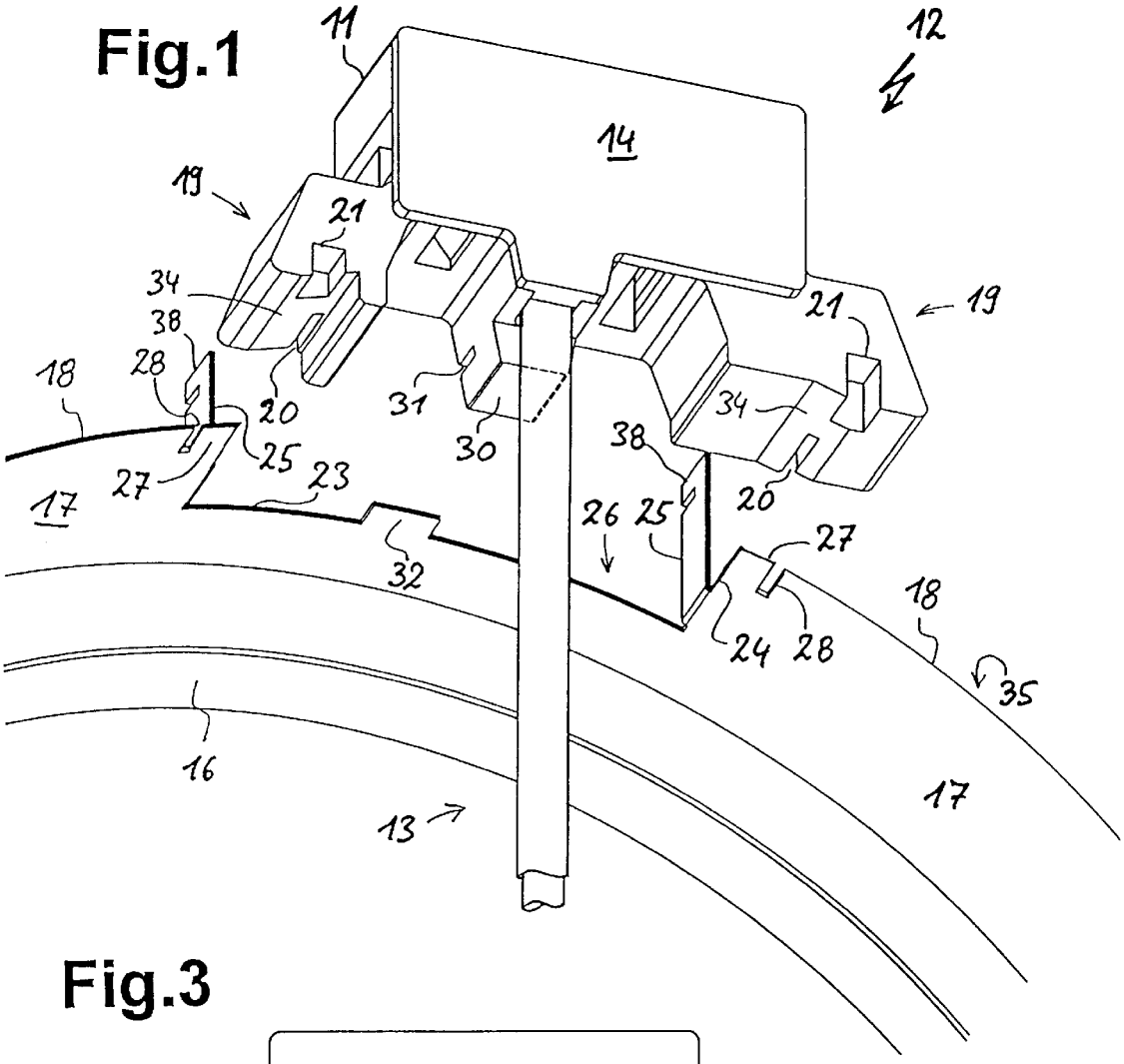
FIG. 1 An oblique view of a casing of a switching device, which can be inserted in a recess in a sheet metal tray rim.

FIG. 1 shows a casing 11 of a thermostat 12, which in the form of a so-called immersion-type thermostat is provided with a rod-shaped temperature sensor 13. The switching device is hidden under the cover 14.

The thermostat is a temperature switching device, which is in particular provided for electric radiant heaters. Its temperature sensor 13 projects over and beyond the electrical resistance heating elements and is located below a glass ceramic plate serving as a hotplate. The thermostat is intended to limit the temperature which can be assumed by the glass ceramic plate to a value acceptable for the glass ceramic material. The temperature sensor comprises a tube and a rod located therein with in each case different thermal expansion coefficients, preferably a stainless steel tube with a ceramic rod therein. This temperature sensor 13 acts on a snap-action switch in the casing 11, which switches on and off the heating of the radiant heater. Optionally it also contains a switch for a hot indication of the glass ceramic plate.

The thermostat 12 is to be fitted to a sheet metal tray 16 serving as a reception container for a not shown heater and in particular on the rim 17 thereof. Roughly parallel to the sheet metal tray 16, the temperature sensor 13 at least partly projects over the latter.

The casing 11 has two bearing shoes 19 by means of which it engages on the sheet metal tray rim 17 and is connected thereto. On their underside the bearing shoes have a through, downwardly open fastening slot 20 and on their top in each case one engagement recess 21. The engagement recesses 21 extend outside the plane of the fastening slots 20 and are preferably outwardly connected directly at the plane of the particular fastening slot 20. In the vicinity of the fastening slots 20 the bearing shoes 19 have bearing surfaces 34 with which, in the inserted state, they bear on the outside 35 of the sheet metal tray rim 17.

The sheet metal tray rim 17 has an approximately rectangular recess 23 with lateral boundaries 24 and a longitudinal boundary 26. In each case longitudinal fastening tongues 25 project parallel outwards from the lateral boundaries 24. On inserting the casing 11 in the recess 23, said fastening tongues 25 engage in the fastening slots 20. At the end the fastening tongues 25 have a twisting tongue 38 twistable through a slot and which is substantially precisely aligned with the back of the bearing shoe 19 and on twisting draws said bearing shoe or the casing 11 against the sheet metal tray rim 17.

In the vicinity of the outer edge 18 of the sheet metal tray rim 17 and adjacent to the lateral boundaries 24 are formed short clamping tongues 27, separated in FIG. 1 by a short notch 28 along one side from the rim 17. The clamping tongues 27 are, as shown in FIG. 1, following the insertion of the casing 11 in the recess 23 bent roughly at right angles outwards into the engagement recesses 21.

Between the bearing shoes 19 the casing 11 has a projection 30 with a downwardly open reception slot 31. On inserting the casing 11 in the recess 23 the projection 30 with the reception slot 31 engages over a holding portion 32, which projects from the longitudinal boundary 26.

Figure 2:
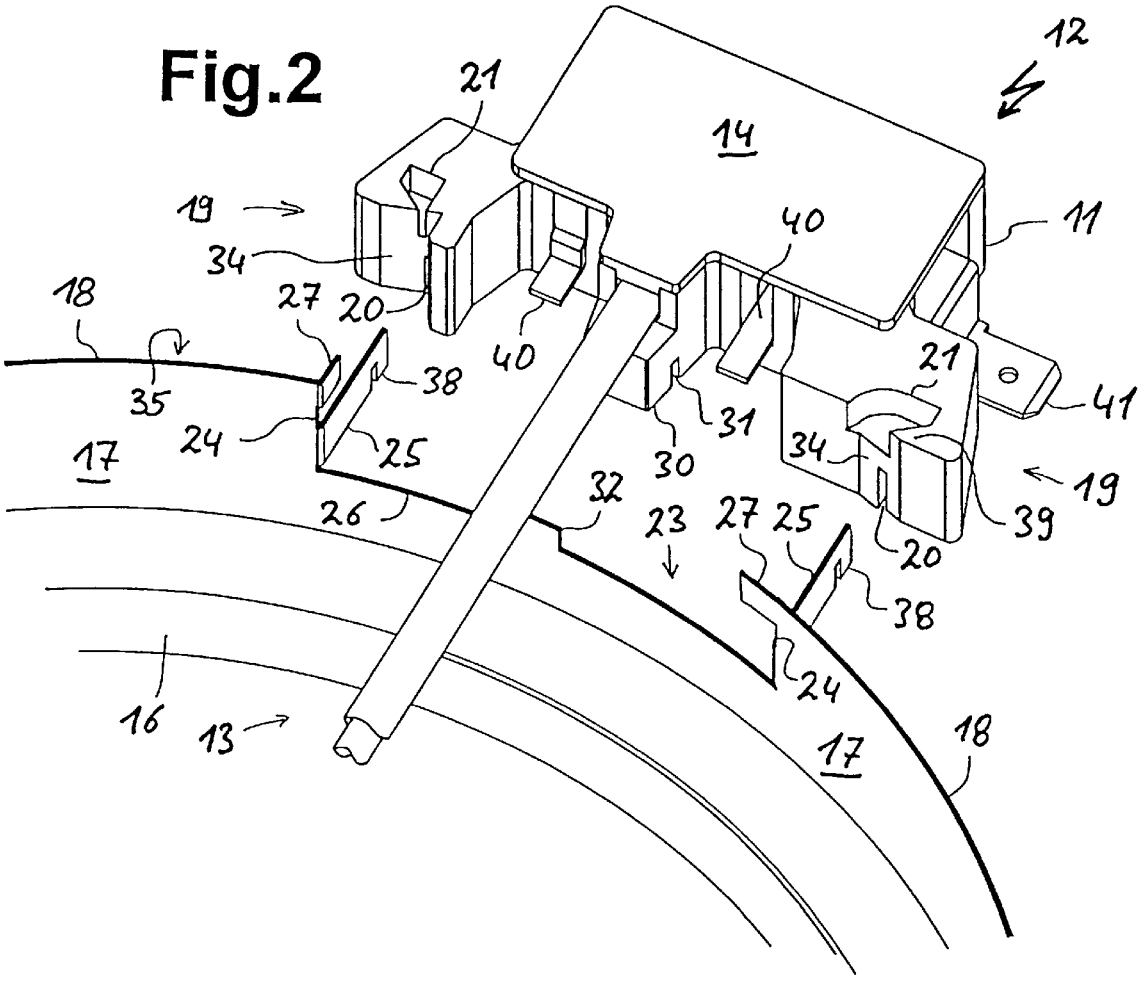
FIG. 2 A modification of the construction of FIG. 1 with alternatively constructed fastening portions.

FIG. 2 shows a casing 11 and a sheet metal tray 16, which essentially correspond to FIG. 1. However, here the clamping tongues 27 are not bent over in engaging manner transversely to the plane of the sheet metal tray 16 into the engagement recesses 21 and instead bending takes place in said plane. The casing 11 is constructed as in FIG. 1, apart from the engagement recess.

The right-hand clamping tongue 27 is left in the original path of the sheet metal tray rim 17. On inserting the casing 11 by bending over outwards it can engage in the correspondingly shaped engagement recess 21 in the right-hand bearing shoe 19 and is placed round a bending corner 39. On bending over the clamping tongue 27 the sheet metal tray rim 17 is braced circumferentially towards the recess in the vicinity of the outer edge 18 and is in this way stabilized. In this way the clamping tongue 27 presses both the casing 11 into the recess 23 and simultaneously braces the sheet metal tray rim 17 for stabilization purposes.

The left-hand clamping tongue 27 with the associated engagement recess 21 are slightly modified. Here at least the fastening tongue 25 and the clamping tongue 27 must be introduced radially into the fastening slot 20 or engagement recess 21 through fitting the casing 11. For inserting the casing 11 the clamping tongue 27 can be alternatively bent upwards and out of the way. It is also possible to extend the fastening slot 20 upwards over the length of the clamping tongue 27 and for it to extend into the engagement recess 21, so that the clamping tongue can remain in the position shown on inserting the casing.

The clamping tongue 27 essentially bears on two surfaces on bending round in the engagement recess 21. Advantageously the surface along which the clamping tongue 27 slides on bending round, i.e. in FIG. 1 the outsides of the engagement recess 21 and in FIG. 2 the bottom surface, rise slightly in the bending round direction. Thus, the holding or retaining force in this direction is increased with increasing bending round.

From the side of the casing 11 directed towards the sheet metal tray 16 project on either side of the temperature sensor 13 two connecting lugs 40, to which can be connected a not shown heating device. A plug-in connecting lug 41 projects to the right from the casing 11 for connection to a power supply.

Figure 3:
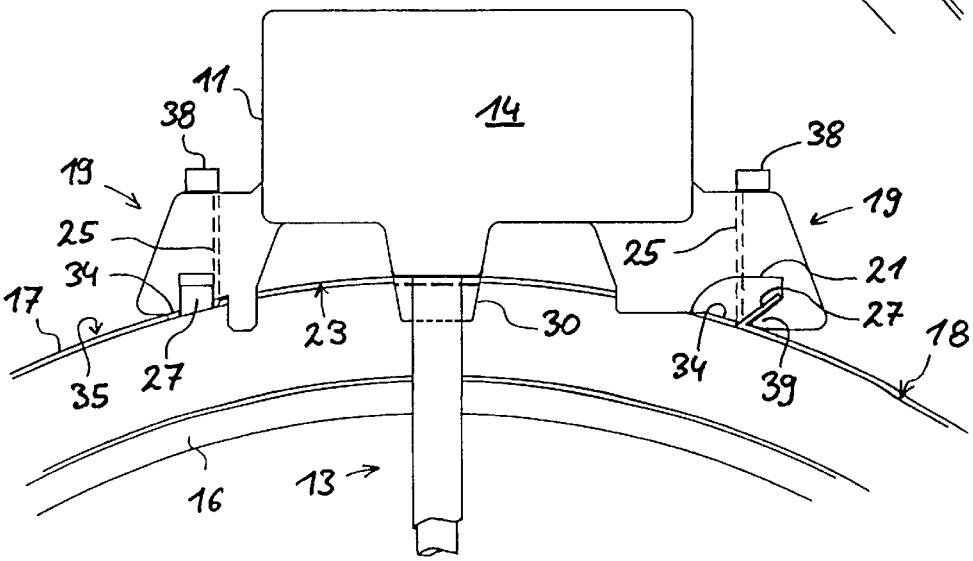
FIG. 3 A casing inserted and fixed in the sheet metal tray rim.

FIG. 3 shows a thermostat 12 fitted to the sheet metal tray 16 and which engages with the two bearing shoes 19 of the casing 11 on the tray rim 17 and is fixed thereto. It is easily possible to see the differing configuration of the bent round clamping tongues 27, to the left according to FIG. 1 and to the right according to FIG. 2. In broken line form is shown the configuration of the fastening tongues 25 through the bearing shoes 19 and by twisting the twisting tongues 38 the thermostat 12 is fixed against the outside of the tray rim 17. The casing is held by the projection 30 or the reception slot 31 engaging over the holding portion 32 on the longitudinal boundary 26 of the recess 23.

The specific fastening arrangement according to an aspect of the invention permits a stable, positionally secure fastening of the thermostat 12 to the sheet metal tray 16. This is advantageous both for a precise temperature determination and for avoiding transportation damage to glass ceramic hobs. By bending the portion 32 radially inwards or outwards the angle between the sensor 13 and the sheet metal tray 16 can be adjusted. Due to the fact that the tongues 25 are bent from the sheet metal tray 16 about a bending line running transversely thereto, they have a very high stability with respect to deformation transversely to the tray 16.

The combination of clamping tongues 27 as portions bracing or clamping together circumferentially the sheet metal tray rim 17 and the fastening tongues 25 as further portions running in fastening slots 20 of the casing 11 and which fix at one point the position of the rim 17 with respect to the casing, has the advantage that the sheet metal tray rim 17 no longer has to be subject to a tensional force. It is instead possible to clamp together the sheet metal tray rim 17, but simultaneously by means of the fastening tongues 25 and optionally also the projections of the casing, to brace it against the fixed point of the casing 11. The sheet metal tray rim 17 is well stabilized by the casing 11. Through a tensioning force inherent in the sheet metal tray rim the thermostat 12 cannot be moved or pivoted.

It is possible through the fastening tongues 25 and clamping tongues 27 shown in the drawings, in each case at the ends of the lateral boundaries 24, to more firmly clamp together the sheet metal tray rim 17 in the vicinity of its outer edge 18 than at the transition to the tray 16. The stability of the sheet metal tray rim 17 can be increased by such an internal bracing.

FIG. 3 shows that the bearing shoes 19 with the bearing surfaces 34 bear from the outside on the sheet metal tray rim 17 substantially on either side of the fastening tongues 25 and/or the clamping tongues 27.

What is claimed is:

1. A fitting of a casing of a switching device, on a rim of a reception container for a heating device, wherein said rim has a recess in which said casing at least partly engages, said recess is provided with two lateral boundaries and is open to the outer edge of said rim and, in the fitted state, said casing is a mechanical connection between said lateral boundaries as a reinforcement of said rim and said casing closes a transmission of forces in the circumference of said rim; and wherein said casing is inserted in said recess from said outer edge towards said rim and at least one portion of said rim on insertion in a corresponding recess engages in said casing, and at least one further portion, by bending round in the inserted state, engages in a corresponding recess in said casing.

2. Fitting according to claim 1, wherein said portions are at least partly constructed as bending tongues, whose bending edge runs substantially along said lateral boundaries.

3. Fitting according to claim 2, wherein at least one bending tongue is bent down prior to the insertion of said casing.

4. Fitting according to claim 1, wherein at least one portion along its configuration has a material weakening in the form of a cross-sectional reduction.

5. Fitting according to claim 4, wherein an end portion separated by said material weakening is an additional twisting tongue for fixing said casing to said rim.

6. Fitting according to claim 1, wherein at least one connection between one of said portions and said casing is radially displaced to the surface in which said recess is located.

7. Fitting according to claim 1, wherein in the vicinity of the two lateral boundaries, in each case at least one portion leads off from said rim.

8. Fitting according to claim 7, wherein said portion leads off from said lateral boundaries and fixes said casing to said rim by twisting an end portion.

9. Fitting according to claim 1, wherein at least one portion bent over following the insertion of said casing at said lateral boundaries braces said rim with said casing in the passage direction of said rim.

10. Fitting according to claim 9, wherein the tensioning force increases with increasing bending round of said portion.

11. Fitting according to claim 1, wherein at least one portion bent round following the insertion of said casing presses the latter into said recess.

12. Fitting according to claim 11, wherein said compressive force rises with increasing bending round of said portion.

* * * * *